United States Patent [19]

Lecuyer et al.

[11] 4,309,698

[45] Jan. 5, 1982

[54] ACOUSTIC FIRE DETECTION CIRCUIT RESPONSIVE TO MICROCAPSULE RUPTURES

[75] Inventors: Daniel Lecuyer, Le Pecq; Anthonius H. Pietersen, Thoiry, both of France

[73] Assignee: La Detection Electronique Francaise Protecbat, Vanves, France

[21] Appl. No.: 64,464

[22] Filed: Aug. 7, 1979

[30] Foreign Application Priority Data

Aug. 9, 1978 [FR] France ..... 78 23453

[51] Int. Cl.[3] ..... G08B 17/08

[52] U.S. Cl. ..... 340/590; 169/58; 340/531; 340/591

[58] Field of Search ..... 340/590, 591, 531; 169/58, 23, 47

[56] References Cited

U.S. PATENT DOCUMENTS 3,014,206 12/1961 Slavin ..... 340/591
3,805,257 4/1974 Litman et al. ..... 340/590
3,811,511 5/1974 McCulloch ..... 340/591
4,001,805 1/1977 Golbe ..... 340/531
4,232,742 11/1980 Dick ..... 169/58

FOREIGN PATENT DOCUMENTS 2305203 10/1976 France ..... 169/58

*Primary Examiner*—Glen R. Swann, III
*Attorney, Agent, or Firm*—Sughrue, Mion, Zinn, Macpeak and Seas

[57] ABSTRACT

For the early detection of an abnormal rise in the temperature in an enclosure to be protected, a large number of micro-containers are arranged in the enclosure. These micro-containers are, for example, incorporated in the paint coating the walls of the enclosure. The micro-containers are filled with an extinguishing gas and produce when they burst a characteristic noise which is detected by microphones. The installation also comprises for the purpose of avoiding false alarms and achieving an adequate discrimination of the useful signal from that produced by the normal surrounding noise, a filtering and processing circuit which operates in an essentially digital manner.

12 Claims, 1 Drawing Figure

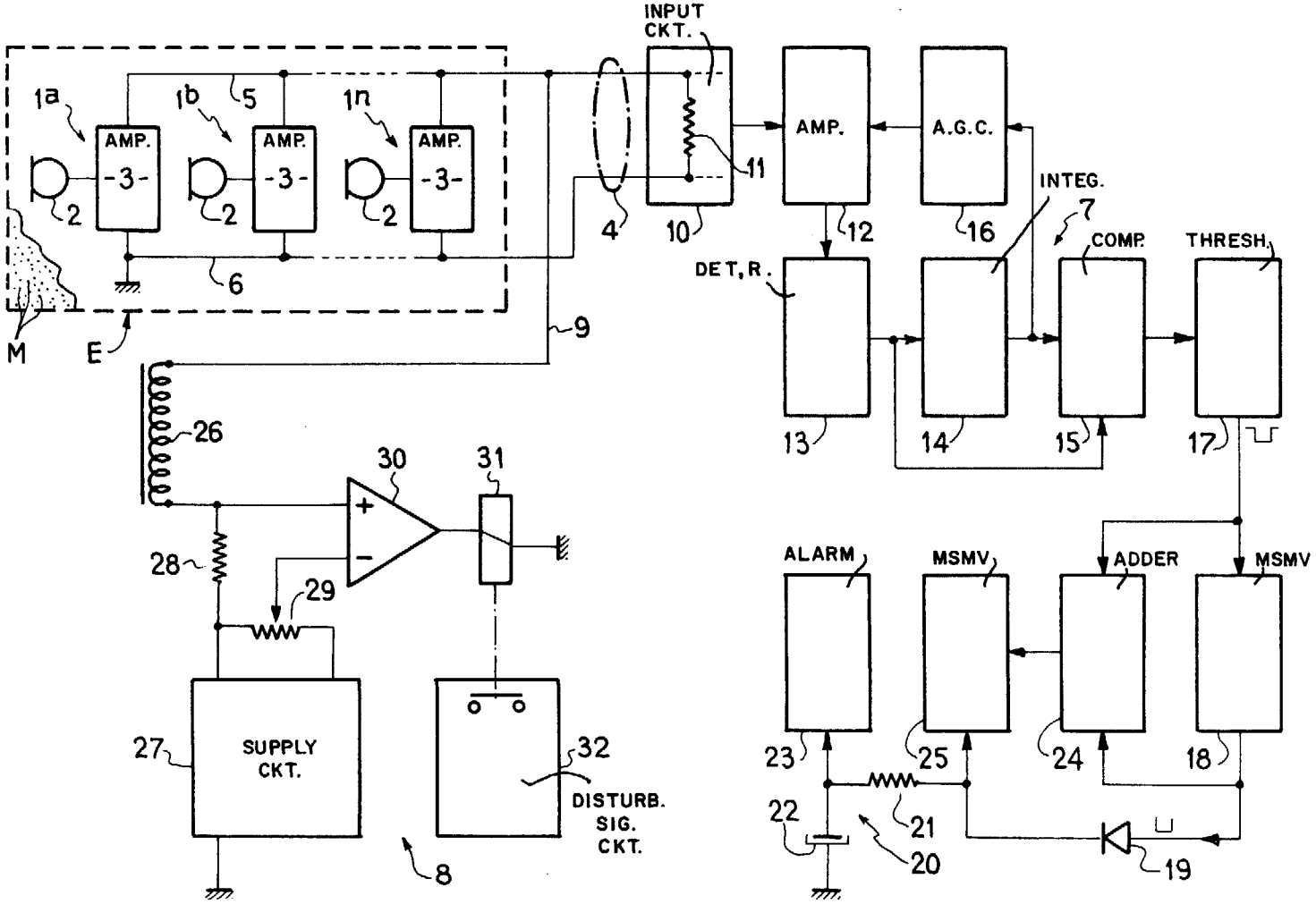
INPUT CKT.
AMP.
A.G.C.
INTEG.
DET, R.
COMP.
THRESH.
MSMV
ADDER
MSMV
ALARM
AMP.
DISTURB. SIG. CKT.
SUPPLY CKT.
1a
1b
1n
M
E

ACOUSTIC FIRE DETECTION CIRCUIT RESPONSIVE TO MICROCAPSULE RUPTURES

BACKGROUND OF THE INVENTION

1. Field of the Invention

The invention relates to protection against fires and more particularly to an installation for detecting fires in the very first stage of development, by the use of micro-containers containing a gaseous fluid which is released by the bursting of the micro-containers when the temperature in the vicinity of these micro-containers reaches a predetermined value.

2. Description of the Prior Art

Conventional fire detecting processes operating by reaction to the heat, smoke, combustion gases or the flames can only intervene when the combustion is sufficiently advanced to produce in the region of the detector a sufficient amount of heat to enable the latter to react, outside normal fluctuation conditions. Depending on the type, the heat excites the detector either directly or by the conveyance of the products of combustion by a rising effect so as to cause them to enter the detector, or this heat brings to a high temperature a body which produces, for example, electromagnetic, infrared or ultraviolet radiations to which the detector is responsive.

All these detecting processes have a major drawback which resides in the fact that the fire can only be detected at a stage of development at which it is already dangerous or its subsequent development is extremely rapid, since, in practice, the detecting devices can only react at the moment at which flames have already developed.

Consequently, it has been attempted to obtain an earlier detection of fires and this is why it has already been proposed (see DAS No. 1 149 277) to employ small explosive cartridges (Knallscheiben) which are for example incorporated in the coat of paint covering the walls of the enclosure to be supervised. However, in this case, the composition of these cartridges, which is purely and simply an explosive, increases the fire rather than tends to put it out, and it is therefore dangerous to proceed in this way, from the point of view of both the fire and persons, above all when there is a danger of explosion in the protected space owing to the nature of the objects therein (chemical or other installations). Further, the DAS No. 1 149 277 is completely silent on the conception of an installation for detecting the noise of the explosions and using this detection of noise, at the right time, for setting off the alarm. Recently, there has been used a new process employing micro-containers containing an extinguishing product, the micro-containers being made from a material which is capable of deteriorating under the effect of a predetermined temperature and thereby releasing the extinguishing product. (See in particular the Dutch application No. 77 13 309 of Dec. 1, 1977 to Anthonius Hermanus Pietersen). The extinguishing product contained in the micro-containers is a gas having a high expansion power such as, for example, bromo-fluoro-alkane which may be $CF_3Br$ in a preferred embodiment. Such a gas has the property of extinguishing and retarding the fire.

The use of these micro-containers has the advantage of permitting the fighting of the initial stage of the fire in the precise region where an abnormal rise in the temperature occurs. Indeed, by their very nature (their diameter is, for example, between 200 and 260 $\mu$m), the micro-containers may be incorporated, for example, in coatings such as paints, furnishing fabrics or the like, or provided in objects having an outer layer of plastics material such as, for example, electric cables.

Up to the present time, it has been proposed to use only the fire extinguishing or retarding property of the gases contained in the micro-containers, which burst under the effect of the temperature. However, under these conditions, it is not possible to rapidly ascertain that the micro-containers have burst in an enclosure to be supervised, so that the personnel in charge of the supervision is only informed of the start of a fire when the detectors of conventional type mentioned hereinbefore have had time to set off an alarm. In other words, the early detection in fact effected by the micro-containers in the precise region of the start of the fire is not utilized.

It is known, from French Pat. No. 1 375 077, to protect a premises against theft by a detection of disturbances or vibrations produced at the moment of breaking in, by means of vibration transducers and to provide a circuit capable of distinguishing the significant vibrations of the breaking in from surrounding vibrations which are always present. However, this circuit, which operates essentially by a filtering of frequency followed by an integration, is not appropriate, owing to the essentially analog nature of the processing of the detected signal and owing to the signal itself, for processing the noise of the bursting of micro-containers which is mainly of a digital nature since it is formed by a series of noise pulses.

SUMMARY OF THE INVENTION

An object of the invention is to provide a fire detecting installation whereby it is possible to utilize immediately the information of digital nature provided by the bursting of the micro-containers described hereinbefore, so as to produce an alarm.

According to the invention, there is provided an installation for the early detection of fire in an enclosure, comprising a large number of small noise producing means distributed in the enclosure and producing this noise upon an abnormal rise in temperature in the enclosure, and an acoustic detecting circuit for detecting noise and setting off an alarm in the presence of said abnormal rise in temperature, wherein said noise producing means are micro-containers each containing an extinguishing gas whose vapour pressure is capable of breaking the micro-container as a result of said rise in temperature and said detecting and alarm circuit comprises at least one microphonic transducer followed by a filtering and digital processing circuit for producing an alarm signal when the noise level produced by the bursting of the micro-containers reaches a predetermined level.

Thus, by means of the installation, it is possible to detect immediately after a local rise in the temperature in the enclosure which is capable of producing the fire, an alarm signal which is produced upon the detection of noise which occurs when the micro-containers burst, the processing of the electric signals delivered by the microphonic transducers being effected in a digital manner so as to ensure an irreproachable discrimination between normal surrounding noises and those produced by the micro-containers when a fire breaks out.

BRIEF DESCRIPTION OF THE DRAWING

Further features of the invention will be apparent from the ensuing description which is given solely by way of example with reference to the accompanying drawing in which the single FIGURE shows a simplified circuit diagram of an installation according to the invention.

DETAILED DESCRIPTION OF THE PREFERRED EMBODIMENT

The single FIGURE shows diagrammatically, in dot-dash lines, an enclosure E, such as a premises in a building for example, whose walls are covered with a coating in which a large number of micro-containers M of the type described in the aforementioned Dutch patent application have been incorporated. It will be understood that this application is not intended to be limitative of the scope of the invention, since the micro-containers may be incorporated in other supports (in particular electric cables).

The installation according to the invention comprises a series of microphonic transducers 1*a* to 1*n* each of which comprises a microphone 2 and an acoustic frequency amplifier 3. Each amplifier 3 is connected by its output to a transmission line 4 having two wires 5 and 6 which serves both for the propagation of the useful signal and the supply of current to microphonic transducers 1*a* to 1*n*. The transmission line 4 is connected to a filtering and utilization circuit 7 and also to a circuit 8 for supplying current and detecting a disturbance, through a connection 9.

The line 4 is connected to an input circuit 10 in which is provided an impedance 11 which is equal to the value of the impedance characteristic of the line, bearing in mind the working frequencies corresponding to those of the noise produced by the bursting of the micro-containers M. The output impedance of each of the amplifiers 3 has a value which is high relative to that of the impedance characteristic of the line 4. Moreover, the characteristics of the microphones 2 and amplifiers 3 are such that each microphonic transducer produces in the line 4 a current which varies linearly as a function of the acoustic pressure applied to the microphones 2 and which is superimposed on the supply current of the amplifiers. Consequently, there is, at the terminals of the impedance 11, a voltage which is proportional to the acoustic pressure detected by all of the microphones. Note also that the fact of providing in the input circuit 10 an impedance 11 whose value is equal to the impedance characteristic of the transmission line 4 does not result in end-of-line reflections (input circuit 10) and that all the useful energy produced by the amplifiers is absorbed by the impedance 11, whereas at the opposite end of the line, which is open, the energy is on the contrary reflected toward the end of the line. Further, owing to this circuit, the signals propagated along the line cannot be cancelled out by phase deviations.

The input circuit 10 also comprises filters for eliminating from the useful signal the industrial and low frequencies up to 5000 Hz, for example. The output of the input circuit 11 is connected to a selective amplifier 12 which is centered on the characteristic frequency band of the noise produced by the bursting of the micro-containers M distributed in the enclosure. This band may range between 10 and 13 KHz, the rejection factor of the amplifier being for example 40 dB.

The output of the amplifier 12 is connected to a detecting circuit 13 which filters a part of given polarity of the signal, this part being transmitted to a mean level integrator 14 comprising an RC circuit and also to the first input of a comparator 15 which receives on its other input the signal issuing from the integrator 14. Moreover, the output of the latter is applied to an automatic gain control circuit 16 whose output is connected to the selective amplifier 12 so as to regulate the gain as a function of the mean signal measured by the integrator 14.

The output of the comparator 15, whose signal is processed in a digital manner, is connected to a threshold circuit 17 whose output is applied to a monostable trigger 18. The output of the latter is connected through a diode 19 to a load circuit 20 comprising a series resistor 21 and a parallel capacitor 22. The junction of these components is connected to an alarm circuit 23 which may be of any design.

The input and output of the monostable trigger 18 are respectively connected to the two inputs of an adder circuit 24 whose output is connected to a monostable trigger 25 discharging the capacitor 22. The output of this trigger is connected to the junction of the diode 19 and the resistor 20.

The circuit for supplying current and detecting a disturbance comprises a filtering self-induction coil 26 connected to one conductor of the line 4 and further connected to a supply circuit 27 through a resistor 28. The supply circuit 27 is connected to a potentiometer 29 for regulating the level, the slide of this potentiometer being connected to the negative input of an operational amplifier 30. The positive input of the latter is connected to the junction between the coil 26 and the resistor 28. The output of the operational amplifier 30 is connected to a relay 31 controlling a circuit 32 for signalling a disturbance.

The operation is as follows:

The acoustic signal detected by the microphones 2 is transmitted, after conversion in the amplifiers 3, through the line 4 to the input circuit 10 and from there to the selective amplifier 12. A part of the output signal of the latter is integrated in the integrator circuit 14 after detection in the circuit 13, whereas this same part is directly applied to the comparator 15 for comparison with the integrated signal. Each time that the pulse level delivered by the detector circuit 13 exceeds the mean level of the signal from the integrator, for example owing to a bursting of a micro-container or to a parasite noise produced in the supervised enclosure, the comparator 15 delivers a signal to the initiating circuit 17. If this signal exceeds the threshold determined by this circuit, a pulse is applied to the monostable trigger 18 which is triggered. The pulse is also applied to the summing circuit 24.

The output pulse duration of the monostable trigger 18 is chosen to be equal to the duration of the signal from the initiating circuit 17 when it is actuated as a result of a bursting of a micro-container. Consequently, following on such a bursting, the adder circuit 24 receives on its two inputs pulses of equal value as a result of which its output signal will be zero. The pulse is then stored in the capacitor 22. If the bursting of the micro-containers continues to be produced, a series of pulses is applied to the capacitor 22 and its signal level will be capable, after a predetermined number of burstings, of actuating the alarm circuit 23. On the other hand, if the threshold circuit 17 is initiated by a signal whose duration is different from that of a signal produced by a bursting, namely by a surrounding noise of the same frequency as that of the burstings, for example, the sum produced in the adder circuit 24 will not be zero. This results in the triggering of the monostable trigger 25 which causes the discharge of the capacitor 22. Such a surrounding noise signal will therefore be incapable of actuating the alarm circuit 23. Thus it can be seen that this digital processing permits the elimination of false alarms and the discrimination from the disturbing surrounding noises.

The supply circuit 27 transmits the supply current to the line 4 through the self-induction coil 26 whose impedance in respect of the considered frequencies is high with respect to that of the resistor 11, its series resistance being on the other hand low relative to the resistor 11.

The considered circuit thus permits detecting a disturbance (for example the opening or short-circuit) of the line 4, the amplifier 30 being adapted to be actuated when its input signals are not equal. Consequently, a warning signal is produced through the relay 31 and the circuit 32.

It will be understood that it is possible to design a circuit in which a single microphone is placed in the enclosure, which renders the line 4 and the supply circuit 8 unnecessary.

Having now described our invention what we claim as new and desire to secure by Letters Patent is:

1. An installation for the early detection of a fire in an enclosure, comprising a plurality of noise producing means distributed in the enclosure and producing said noise upon an abnormal rise in the temperature in the enclosure, and an acoustic detecting circuit for detecting noise and setting off an alarm in the presence of said abnormal rise in temperature, said noise producing means being micro-containers each containing an extinguishing gas which has a vapour pressure capable of breaking the micro-container as a result of said rise in temperature and said detecting and alarm circuit comprises at least one microphonic transducer and a combined filtering circuit and digital processing circuit connected to the transducer for producing an alarm signal when the noise level produced by the bursting of the micro-containers reaches a predetermined level.

2. An installation as claimed in claim 1, wherein said combined filtering circuit and digital processing circuit comprises a selective amplifier having a band pass which is centered on a frequency range corresponding to a spectrum of noise produced by said micro-containers.

3. An installation as claimed in claim 2, wherein said frequency range is between about 10 and 13 KHz.

4. An installation as claimed in claim 2, wherein said combined filtering circuit and digital processing circuit comprises a circuit for establishing a mean of the signal issuing from said selective amplifier and a comparator for effecting a comparison between said signal and the mean thereof.

5. An installation as claimed in claim 4, wherein a detector is connected between said mean establishing circuit and an output of said selective amplifier and said detector is directly connected to said comparator and indirectly connected to said comparator through said mean establishing circuit.

6. An installation as claimed in claim 5, wherein said mean establishing circuit is an integrator.

7. An installation as claimed in claim 4, 5 or 6, wherein said comparator has an output connected to a threshold circuit.

8. An installation as claimed in claim 6, wherein said combined filtering circuit and digital processing circuit further comprise a threshold circuit for delivering pulses which may be representative of the bursting of the micro-containers, an alarm circuit, a storage capacitor connected to the alarm circuit for actuating the alarm circuit when the charge of the capacitor reaches a predetermined level, a digital circuit connected to the capacitor for charging the capacitor, the threshold circuit having an output connected to the digital circuit so that the digital circuit is responsive to the output of the threshold circuit for increasing the level of charge of the capacitor only in the presence of a signal which is representative of the bursting of said micro-containers, and a digital discharge circuit connected to the capacitor for discharging the capacitor and connected to the output of the threshold circuit so as to be responsive to the output of the threshold circuit for discharging the capacitor in the presence of any other signal which is representative of any parasite noise in the enclosure.

9. An installation as claimed in claim 8, wherein said charging circuit and said discharging circuit are monostable triggers, the trigger acting as a charging circuit having an input and an output interconnected by an adder circuit having an output to which output there is connected the monostable trigger acting as the discharging circuit, the output pulse duration of the first trigger being so regulated as to be equal to the duration of the threshold circuit output signal which is representative of the noise of the bursting of a micro-container.

10. An installation as claimed in any one of the claims 1 to 3, comprising a series of microphonic transducers which are connected in parallel in a transmission line which is closed at one end by an impedance equal to its characteristic impedance for the frequencies which are characteristic of the bursting of the micro-containers, said transducers being distributed in said enclosure.

11. An installation as claimed in claim 1, comprising a series of microphonic transducers which are connected in parallel in a transmission line which is closed at one end by an impedance equal to its characteristic impedance for the frequencies which are characteristic of the bursting of the micro-containers, said transducers being distributed in said enclosure, and each transducer comprising a microphone and an amplifier and a supply circuit for said amplifiers being connected to said transmission line through a filtering self-inductance coil.

12. An installation as claimed in claim 11, wherein said supply circuit comprises a circuit which is for detecting a disturbance and is capable of supervising the potential at the terminals of said self-inductance coil so as to actuate means producing a warning signal in the case of a disturbance of said line.

* * * * *